US006818156B1

(12) United States Patent
Miller

(10) Patent No.: US 6,818,156 B1
(45) Date of Patent: Nov. 16, 2004

(54) ELECTROTHERMIC COATINGS AND THEIR PRODUCTION

(75) Inventor: Cole F. Miller, Dublin, OH (US)

(73) Assignee: Active Coatings, Inc., Columbus, OH (US)

( * ) Notice: Subject to any disclaimer, the term of this patent is extended or adjusted under 35 U.S.C. 154(b) by 246 days.

(21) Appl. No.: 10/224,873

(22) Filed: Aug. 21, 2002

(51) Int. Cl.[7] ..... H01B 1/24
(52) U.S. Cl. ..... 252/511; 427/58
(58) Field of Search ..... 252/511; 427/58

(56) References Cited

U.S. PATENT DOCUMENTS 5,549,849 A * 8/1996 Namura et al. ..... 252/503

6,086,791 A * 7/2000 Miller ..... 252/511

* cited by examiner

*Primary Examiner*—Mark Kopec
(74) *Attorney, Agent, or Firm*—Mueller and Smith, LPA

(57) ABSTRACT

A coating composition, effective in emitting heat without breaking down when connected to a source of electricity, is formulated from a binder; an electrically conductive carbon black particle generated by high temperature pyrolysis of acetylene and having a particle size between of between about 5 and 500$\mu$; an electrically conductive graphite particle having a degree of crystallinity of at least about 67% and having a particle size between about 5 and 500$\mu$; and a volatile solvent. The weight amount of (b) and (c) together ranges from between about 10 and 75 weight-% based on the non-volatile solids content of the coating composition.

20 Claims, 1 Drawing Sheet

ELECTROTHERMIC COATINGS AND THEIR PRODUCTION

CROSS-REFERENCE TO RELATED APPLICATIONS

None

STATEMENT REGARDING FEDERALLY SPONSORED RESEARCH

Not applicable.

BACKGROUND OF THE INVENTION

The present invention relates to coatings that are able to evolve heat when connected to a source of electricity (electrothermic coatings) and more particularly to electrothermic coatings that utilize non-metallic particles for achieving remarkable heating characteristics.

The art has proposed "electrically conductive" coatings utilizing metallic particles for anti-static applications. Coatings based on non-metallic particles even appear in the literature. These coatings, however, typically only generate low amounts of heat and often break down the binder when asked to achieve moderate to high temperatures (say, in excess of around 100° C.). Nevertheless, the art is replete in such exothermic coatings teachings.

Namura (U.S. Pat. No. 5,549,849) proposes a combination of graphite particles, metal particles, and carbon black to prepare conductive coatings. Miller (U.S. Pat. No. 6,086,791) proposes a non-metallic electrically conductive coating composition effective in emitting heat without break-down when connected to a source of electricity, which coating composition is made from a binder; electrically conductive flake-like carbon black particles ranging in size from between about 5 and 500$\mu$; electrically conductive flake-like graphite particles ranging in size from between about 5 and 500$\mu$; and a volatile solvent. The weight amount of flake-like carbon black particles and flake-like graphite particles together ranges from between about 10 and 75 weight-% based on the non-volatile solids content of the coating composition.

The present invention solves many of the problems encountered in the art in formulating non-metallic electrothermic coatings.

BRIEF SUMMARY OF THE INVENTION

A coating composition, effective in emitting heat without breaking down when connected to a source of electricity, is formulated from a binder; an electrically conductive carbon black particle generated by high temperature pyrolysis of acetylene and having a particle size between of between about 5 and 500$\mu$; an electrically conductive graphite particle having a degree of crystallinity of at least about 67% and having a particle size between about 5 and 500$\mu$; and a volatile solvent. The weight amount of (b) and (c) together ranges from between about 10 and 75 weight-% based on the non-volatile solids content of the coating composition.

The novel coatings are made conventionally by initially forming a pigment grind and then letting down the grind in additional solvent with the incorporation of additives as is necessary, desirable, or convenient. The binder should be able to withstand the expected temperatures of the coating and, thus, should be temperature resistant silicone resins, polyamide resins, bis-maleimide resins, and the like.

In another aspect of the present invention a metal oxide particle is added to the coating composition. When such a coating is drawn down as a film, cured, and electrically energized, the film glows, i.e., emits IR energy.

Advantages of the present invention include the ability to generate temperatures ranging up to around 600° F. Another advantage is the ability to produce a self-regulating temperature coating. A further advantage is that the inventive coating maintains its coating properties and can be applied, inter alia, by brush, roller coat, reverse roller coat, spray, and the like. These and other advantages will be readily apparent to those skilled in this art.

DETAILED DESCRIPTION OF THE INVENTION

Figure 1:
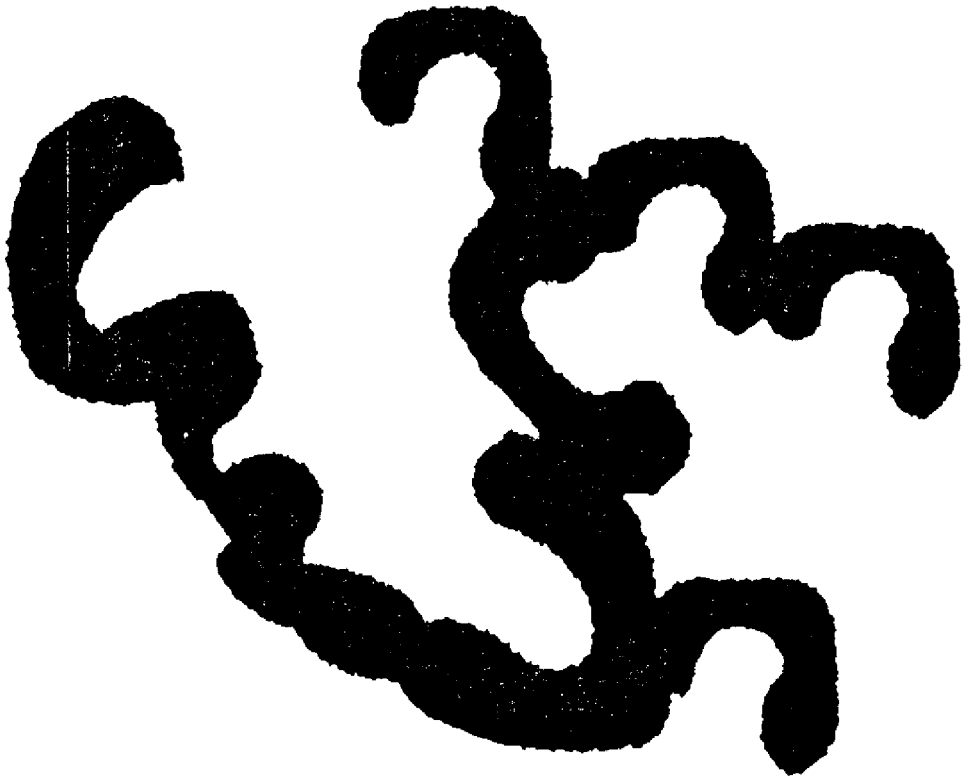
FIG. 1 is a schematic illustration of Ketjenblack EC as found in the Ketjenblack® EC technical bulletin issued by Akzo Nobel Chemicals bv, The Netherlands. This bulletin depicts the primary aggregate of Ketjenblack EC as having an egg-shell particle form having high pore volume due to its unique shape. As can be seen in FIG. 1, the carbon black particle aggregate is shown to have hollow shell morphology with distinct pore volume and surface area consistent with an egg-shell particle form.

The inventive paint is unique in its ability to function as a conventional coating with expected coating properties while concomitantly being electrically conductive. Such electrical conductivity further translates into the ability to generate heat (electrothermic coating) to the point of being useful in a wide variety of applications, such as, for example, heating of floors, walls, ceilings, roofs, and gutters. Further uses include preheating of engine oils in transport vehicles and power plants, local heating of batteries and auxiliary systems, heating cars and tankers carrying oil and other liquids, coal carrying vehicles, and for de-icing of aircraft wings. Additional uses include warming of components subjected to cold temperatures in use, heating of highways and other outdoor structures Including, for example, airplane wing de-icing. Yet other uses include home/commercial appliances (dryers, irons, clothes presses, space heaters, cooking surfaces such as stoves, hot plates, woks, toasters, water heaters, coffee makers, furnaces, hot tubes, commercial/industrial/home ovens, etc.), medical equipment, as a replacement for resistant heating devices, and the like. Surely the foregoing list is merely illustrative and a wide variety of additional uses will become apparent based on the disclosure set forth herein.

In order to achieve such remarkable heating capability, the present invention relies on carbon black particles that are made by the high temperature pyrolysis of acetylene. In particular, acetylene, which is pyrolized at temperatures of around 8000° F., has proven to be quite useful in the context of the present invention. Commercially, such carbon black particles are available from Akzo Nobel Polymer Chemicals LLC, Chicago, Ill. 60606, under the KETJENBLACK® trademark. Such carbon black particles are characterized also by having a surface area of between about 800 and 1250 $m^2/g$ (BET), being highly branched in structure, being highly porous, having a bulk density ranging from about 100 to 145 $kg/M^3$, and being shell-like in structure (i.e., having a think "egg shell" outer layer which is hollow inside). FIG. 1 schematically represents this particle. Formulations tested to date have exhibited their exothermic characteristics for 7 weeks at a defined stable temperature. Extended time testing yet continues.

Use of the acetylene-based carbon black particles alone, however, will not result a stable coating system. That is, the coating will continue to heat until it burns out (i.e., breaks down). It was unexpectedly discovered that a graphite or carbon particle of lesser electrical conductivity should be added to the coating formulation. In particular, the graphite added to the formulation also should have a degree of crystallinity of greater than about 67%. At lower degrees of crystallinity, the temperatures generated by the electrothermic coatings are not useful. The size of all carbon-based particles should range from about 0.001 to about 500$\mu$ in average particle size. Since the graphite has a lower electrical conductivity than the carbon black, the graphite appears to act as a resistor in the coating composition.

Another unique feature is the ability of the coating to become scratched, yet still maintain is electrical conductivity and exothermic properties. This makes repair of the coating facile and should prove to be an important characteristic for commercial implementation of the present invention.

Since the coating generates such high quantities of heat, the binder used necessarily must be able to withstand such elevated temperatures. Thus, heat-stable resins should be used including, for example, acrylics, alkyds, cellulosics, epoxies, fluoro-plastics, ionomers, natural rubber, nylons, phenolics, polyamides, polybutadiene, polyesters, polyimides, polypropylene, polyurethanes, silicone resins, silicone rubber, styrene-butadiene; nitrile rubber, polysulphide rubber, vinyl-ethylene, polyvinyl acetate, silicates and polysilicates; hydraulic setting Portland cement, sodium aluminate and gypsum (Plaster of Paris); glass compositions, including glass fruits; ceramic and refractory compositions; and minerals, such as bentonites, and the like. Of importance is that such resins have the ability to withstand elevated temperatures without loss of integrity of the paint. Those skilled in the resin arts will readily be able to provide a wide variety of such temperature-stable resins. See, for example, Solomon, *The Chemistry of Organic Film Formers*, Robert E. Krieger Publishing Company, Huntington, N.Y. (1977), the disclosure of which is expressly incorporated herein by reference.

Other additives are incorporated Into the formulation in conventional fashion. These additives include, inter alia, opacifying pigments and inert extenders such as, for example, titanium dioxide, zinc oxide, clays such as kaolinite clays, silica, talc, and the like. Additionally, the coating composition can contain corrosion inhibiting pigments, plasticizers, pigment suspending agents, flow leveling agents, catalysts, drying agents, surfactants, tinctorial pigments, and a wide variety of other conventional additives.

When metal oxides, typified by MgO and ZnO, are added to a formulation having between about 5% and 25% carbon and the cured coating electrically heated to between about 105° and 178° F., the coating emits IR energy to the extent of about 48 lumens (the coating emits visible light). Such infrared (IR) emission generated by electrical heating was quite unexpected, yet definitely is present, as the examples will demonstrate. A variety metal oxide powders are believed to be operable in this embodiment of the present invention.

The inventive paint can be applied to a substrate by direct roll coat or curtain coating with or without a knife, reverse roller coat, atomized application, or like conventional techniques. Cure of the coating can be simple air-drying or it can involve baking at a temperature and for a time for cure of the binder system employed, solvents used, and like factors well known to those in the coatings field.

The following examples show how the present invention has been practiced. They should be construed as illustrative of the invention and not a limitation of it. In this application, all references cited are expressly incorporated herein by reference.

IN THE EXAMPLES

The following general procedure was used in compounding the formulations reported in the examples, 1. Grind the pigments and fillers in a high-speed mill set at HIGH for 1 minute to meet grind size requirements.
2. In a separate vessel (1.5 hp lab mixer capable of 600 to 8700 rpm), blend the binder and solvent at HIGH for 1 minute.
3. Slowly add the pigment/filler mixture to the binder/solvent mixture at LOW speed in a blender over a 2-3 minute time period, then advance the speed to MEDIUM for 2 minutes and then HIGH speed for 1 minute. Check to see if grind level has been achieved (repeat mixing if needed), then check viscosity (add additional solvent if necessary).
4. Store coating in a glass container with a sealing lid.

The electrically conductive exothermic coating then was formed as follows:

5. Apply copper foil electrodes (0.25 in. wide×2 mil thick× desired length) to substrate to be coated along opposite edges of the surface to receive the coating with adhesive (self-adhesive backing has been used).
6. Clean and dry the surface to be coated.
7. Mask the surface of the substrate to be coated such that the electrodes and the are between the electrodes will be able to receive the coating. Be sure to mask the ends of the electrodes so that the copper foil is available to be soldered to a power source.
8. Apply coating using a conventional air spray gun using approximately 3 passes to produce a uniform coating of about 25 micrometers.
9. Let the applied paint film air dry for about 2 hours or oven bake at 200° F. for 20 minutes.
10. Solder electrical wire leads to the ends of the copper electrodes.
11. Connect the leads to a variable electrical source (0–120 volts a.c @ 1–5 amps).
12. Slowly apply electrical current to the coating, monitoring thermal characteristics.

The following ingredients were used in compounding the formulations tested:

| | |
|---|---|
| Lamp Black 101 | A 209 blackness blue My lamp black, typical analysis: DBP adsorption of 117 ml/100 g, 7.5 pH, 0.02% ash content, 20 $m^2$/g BET surface area, 95 nm avg. primary particle size; Degussa Corporation, Parsippany, NJ |
| 5303 Carbon | Coconut shell carbon black powder, typical analysis: 30 nm particle size, 87% tint, 259 BET S/A $m^2$/g, 192 cc/100 g oil absorption, 6 lb/$ft^3$ pour density; Asbury Graphite Mills, Inc., Asbury, NJ |
| KetjenblackEC-600JD | Carbon black, 1000–1150 mg/g Iodine absorption, 480–510 ml/100 g DBP pore volume, 0.5 wt-% moisture max, 1.0 wt-% volatiles max, 0.1 wt-% ash max, 0.8 wt-% fines, 8–10 pH, 100–120 kg/$m^3$ bulk density, Akzo Nobel Polymer Chemicals LLC, Chicago, IL 60606 |

-continued

| | |
|---|---|
| KetjenblackEC-300J | Carbon black, 740–840 mg/g Iodine absorption, 310–345 ml/100 g DBP pore volume, 0.5 wt-% moisture max, 1.0 wt-% volatiles max, 0.1 wt-% ash max, 0.8 wt-% fines, 8–10 pH, 125–145 kg/m$^3$ bulk density, Akzo Nobel Polymer Chemicals LLC, Chicago, IL 60606 |
| Printex XE-2 Carbon Pigment | A highly conductive carbon pigment, MW of 12, flake-like structure, 1,000 $\mu$M grind level, MSDS #1017, Degussa Corporation, Parsippany, NJ |
| Printex XE2-B Carbon Pigment | A beaded pigment black, 1125 mg/g Iodine Adsorption, 420 ml/100 g DBP Adsorption, 7.5 pH, 1.6% ash content, 1000 m$^2$/g BET surface area, 20 nm avg. primary particle size, Degussa Corporation, Parsippany, NJ |
| PrintexF Alpha | A regular color furnace pigment 0.5% volatile matter, 100 ml/100 g DBP Adsorption, 9 pH, 0.02% ash content, 100 m$^2$/g BET surface area, 20 nm avg. primary particle size, Degussa Corporation, Parsippany, NJ |
| FW1 Carbon Black | A high color gas pigment black, 5% volatile matter @ 950° C., 4 pH, 0.02% ash content, 260 m$^2$/g BET surface area, 13 nm avg. primary particle size, Degussa Corporation, Parsippany, NJ |
| FW2 Carbon Black | A high color gas pigment black, 16.5% volatile matter @ 950° C., 2.5 pH, 0.02% ash content, 350 m$^2$/g BET surface area, 13 nm avg. primary particle size, Degussa Corporation, Parsippany, NJ |
| FW200 Carbon Black | A high color gas pigment black, 20% volatile matter @ 950° C., 2.5 pH, 0.02% ash content, 550 m$^2$/g BET surface area, 13 nm avg. primary particle size, Degussa Corporation, Parsippany, NJ |
| Printex 35 Carbon Pigment | A low color furnace conductive pigment, 0.5% volatile matter @ 950° C., 9 pH, 0.03% ash content, 65 m$^2$/g BET surface area, 31 nm avg. primary particle size, Degussa Corporation, Parsippany, NJ |
| Printex 90 Carbon Pigment | A high color gas pigment black, 1% volatile matter @ 950° C., 95 ml/100 g DBP adsorption, 9 pH, 0.04% ash content, 300 m$^2$/g BET surface area, 14 nm avg. primary particle size, Degussa Corporation, Parsippany, NJ |
| NIPex150 | Xerographic toner carbon black with the following specifications: 110 m$^2$/g BET surface area, 25 nm primary particle size, pH of 4, Degussa-Huls |
| NIPex180IQ | Ink jet carbon black with the following specifications: 260 m$^2$/g BET surface area, 15 nm primary particle size, pH of 4, Degussa-Hüls |
| Hi-Black 40B2 Carbon Pigment | A general purpose conductive carbon black with the following specifications: DBP absorption 145–155 ml/100 g, tinting strength 100%–110%, sieve reside (45 $\mu$m) ≦0.5%, pH value 6–10; Degussa Corporation |
| 2935K Graphite Pigment | Purified natural graphite, 99.8% carbon content, 0.2% ash level, 125 mesh grind level, 325 mesh (US) particle size, MSDS #2935K, Superior Graphite Co. |
| Superior 4672<br>Superior 2939<br>Superior 2967<br>Superior 4691<br>Superior 2120<br>Superior 6010 | Synthetic versions of 2935K graphite pigment, 97–99% carbon content, Superior Graphite Co. |
| 850 Silicone Resin | "Flame Control" Kem Hi-Tem Coating, No. 850 Series, MSDS #7.06b, high temperature rating (>600° F.), silicone alkyd resin reduced in xylene, Sherwin Williams Co. |

EXAMPLE 1

Coatings were compounded from Ketjenblack 600EC (10 g) and a carbon resister (5 g) dispersed in xylol solvent and 850 silicone resin. One coat was drawn down on the substrate, cured, and tested as described above. The following results were recorded.

TABLE 1

| Ketjenblack 600 EC (10 g)* | | | | | |
|---|---|---|---|---|---|
| Carbon | S—Stable U—Unstable | Xylene (ml) | 850 Silicone (ml) | Temp (° F.) | Current (amp) |
| XE2 | S | 150 | 200 | 360 | 1.6 |
| XE2B | S | 150 | 200 | 354 | 1.7 |
| Lamp Black 101 | S | 150 | 200 | 300 | 1.9 |
| FW1 | S | 130 | 200 | 290 | 1.6 |
| FW2 | S | 140 | 200 | 260 | 1.9 |
| FW200 | S | 120 | 200 | 230 | 1.9 |
| 50L | S | 150 | 180 | 211 | 1.8 |
| 600L | S | 150 | 180 | 200 | 1.7 |
| Hi-Black 40B2 | S | 150 | 180 | 354 | 1.6 |
| 35 | N | 150 | 200 | 70 | 1.5 |
| 90 | N | 150 | 200 | 90 | 1.6 |
| 130 | N | 150 | 200 | 160 | 1.6 |
| 180IQ | S | 150 | 200 | 160 | 1.6 |
| F Alpha | S | 150 | 200 | 160 | 0.64 |
| XPB-191 | S | 150 | 200 | 110 | 0.50 |

*110 volts for all tests

The above-tabulated data demonstrates that high temperature-fired, acetylene carbon black can be used with a variety of resistive (i.e., less conductive) graphite particles in a resin system to produce coating compositions that can generate a controlled amount of heat without burning up the coating.

EXAMPLE 2

Additional coatings were compounded from Ketjenblack 600EC (10 g) and a carbon resister (5 g) dispersed in xylol solvent and 850 silicone resin. One coat was drawn down on the substrate, cured, and tested as described above. The following results were recorded.

TABLE 2

| Ketjenblack 600 EC (10 g)* | | | | | |
|---|---|---|---|---|---|
| Graphite | S—Stable U—Unstable | Xylene (ml) | 850 Silicone (ml) | Temp (° F.) | Current (amp) |
| Corax N110 | S | 120 | 190 | 190 | 1.2 |
| Corax 115 | S | 120 | 200 | 160 | 1.2 |
| Corax 209 | S | 120 | 200 | 130 | 1.6 |
| Corax 330 | S | 120 | 200 | 140 | 1.3 |
| Corax 339 | S | 120 | 200 | 210 | 1.9 |
| Corax 650 | S | 120 | 200 | 60 | 1.1 |
| Corax 762 | S | 120 | 190 | 240 | 1.7 |
| Corax P0880 | U | 140 | 210 | 314 | 1.3 |
| Corax P4890 | U | 140 | 210 | 320 | 1.9 |
| Corax P6990 | U | 140 | 210 | 296 | 1.6 |

*110 volts for all tests

The above-tabulated data demonstrates that high temperature-fired, acetylene carbon black can be used with a variety of resistive (i.e., less conductive) graphite particles in a resin system to produce coating compositions that can generate a controlled amount of heat without burning up the coating. These results further demonstrate that a high crystalline structure of the resistor carbon is important in obtaining stability of the electrothermic coating system. In particular, the crystallinity should be in excess of about 67% for stability of the coating system.

In related testing, stability of the inventive electrothermic coating system has been achieved by maintaining a 530° F.

temperature on a ceramic tile substrate for 7 months (2.6 amps @ 110 v). This test is on-going.

EXAMPLE 3

Additional coatings were compounded to generate infrared energy. These coatings were compounded from Ketjenblack 600EC (92.6 g), a graphite (92.6 g), magnesium dioxide (6.2 g), zinc oxide (1.2 g), 850 silicone resin (100 ml), and xylene solvent (20 g). These formulations were drawn down and test with the following results being recorded.

TABLE 3

| Graphite (Superior) | % Crystallinity of Graphite | Current (amps) | Voltage (V) | Temperature (° F.) |
|---|---|---|---|---|
| 2939 | 99 | 1 | 110 | 260 |
| 2935 | 99 | 1 | 110 | 240 |
| 4672 | 97 | 1 | 110 | 210 |
| 2967 | 70 | 1 | 110 | 110 |
| 4691 | 70 | 1 | 110 | 90 |
| 2120 | 70 | 1 | 110 | 90 |
| 6010 | 67 | 1 | 110 | 70 |

The results demonstrate that the higher the degree of crystallinity of the graphite resistive material in the coating formulations the higher the resulting stable temperature that the electrothermic coating composition can generate. The addition of $MgO_2$ and ZnO only add to the infrared energy that the coating generates because of the Ketjenblack and graphite materials heating these metal oxide pigments, which then radiate their heat. About 48 lumens has been measured for this formulation, provided the temperature is maintained between about 105° and 178° F.

EXAMPLE 4

Several coatings were compounded, drawn down on 12"×12"ceramic tiles, connected to a voltage source, and the temperature generated by the coating measured. The following results were recorded.

TABLE 4

| Ingredient | No. 1 | No. 2 | No. 3 | No. 4 | No. 5 | No. 6 | No. 7 |
|---|---|---|---|---|---|---|---|
| Ketjenblack (g) | 10 | 10 | 10 | 10 | 5 | 5 | 5 |
| 2935K Graphite (g) | 20 | 10 | 5 | 20 | — | — | — |
| Printex XE-2 Carbon Black Pigment (g) | — | — | — | — | 10 | — | — |
| 5303 Carbon Black (g) | — | — | — | — | — | 10 | — |
| Hi-Black 40B2 Carbon Black (g) | — | — | — | — | — | — | 10 |
| Kem Hi-Tem Coating, No. 850 Series Silicone Resin (ml) | 175 | 160 | 160 | 200 | 225 | 225 | 225 |
| Xylene (ml) | 100 | 100 | 100 | 100 | 110 | 100 | 100 |
| Viscosity @ 28° C. (poises) | 31 | 30 | 27 | 26 | 36 | 32 | — |
| Test: | | | | | | | |
| Voltage (volts) | 25 | 110 | 110 | 208 | 110 | 260 | 110 |
| Current (amps) | 1 | 1 | 1 | 1.90 | 0.64 | 0.64 | 0.8 |
| Temperature (° F.) | 270 | 234 | 289 | 415 | 192 | 490 | 196 |

The above-tabulated results demonstrate again demonstrate the efficacy of the inventive electrothermic coating system.

I claim:

1. A coating composition effective in emitting heat without breaking down when connected to a source of electricity, which comprises:

(a) a binder;

(b) an electrically conductive carbon black particle generated by high temperature pyrolysis of acetylene and having a particle size between of between about 0.001 and 500$\mu$;

(c) an electrically conductive graphite particle having a degree of crystallinity of at least about 67% and having a particle size between about 0.001 and 500$\mu$; and (d) a volatile solvent;

wherein the weight amount of (b) and (c) together ranges from between about 5 and 75 weight-% based on the non-volatile solids content of the coating composition.

2. The electrically conductive coating composition of claim 1, wherein the weight amount of (b) and (c) together ranges from between about 10 and 20 weight-% based on the non-volatile solids content of the coating composition.

3. A dried film of the electrically conductive coating composition of claim 2.

4. The electrically conductive coating composition of claim 1, wherein each of said carbon (b) and said graphite (c) is present in an amount of at least about 1 wt-%.

5. A dried film of the electrically conductive coating composition of claim 4.

6. The electrically conductive coating composition of claim 1, wherein said binder is one or more of an acrylic, an alkyd, a cellulosic, an epoxy, a fluoro-plastic, an ionomer, a natural rubber, a nylon, a phenolic, a polyamide, a polybutadiene, a polyester, a polyimide, a polypropylene, a polyurethane, a silicone resin, a silicone a natural rubber, a styrene-butadiene; a nitrile rubber, a polysulphide rubber, a vinyl-ethylene, a polyvinyl acetate, a silicate or polysilicate; a hydraulic setting Portland cement, a sodium aluminate or gypsum (Plaster of Paris); a glass composition; a ceramic or refractory composition; or mineral.

7. A dried film of the electrically conductive coating composition of claim 6.

8. The electrically conductive coating composition of claim 1, which additionally contains metal oxide particles.

9. A dried film of the electrically conductive coating composition of claim 8.

10. The electrically conductive coating composition of claim 8, wherein said metal oxide particles are one or more of ZnO or MgO.

11. A dried film of the electrically conductive coating composition of claim 10.

12. A dried film of the electrically conductive coating composition of claim 1.

13. A method for generating heat, which comprises the steps of:

(a) forming a dried film on a substrate from a coating composition which comprises:

(1) a binder;

(2) an electrically conductive carbon black particle generated by high temperature pyrolysis of acetylene and having a particle size between of between about 5 and 500$\mu$;

(3) an electrically conductive graphite particle having a degree of crystallinity of at least about 67% and having a particle size between about 5 and 500$\mu$; and (4) a volatile solvent;

wherein the weight amount of (b) and (c) together ranges from between about 10 and 75 weight-% based on the non-volatile solids content of the coating composition, (b) attaching electrode s to said dried film;

(c) connecting said electrodes to a source of electricity; and (d) energizing said source of electricity.

14. The method of claim 13, wherein said dried film is formed from a coating composition in which the weight amount of (b) and (c) together ranges from between about 10 and 20 weight-% based on the non-volatile solids content of the coating composition.

15. The method of claim 13, wherein said dried film is formed from a coating composition wherein said binder is one or more of an acrylic, an alkyd, a cellulosic, an epoxy, a fluoro-plastic, an ionomer, a natural rubber, a nylon, a phenolic, a polyamide, a polybutadiene, a polyester, a polyimide, a polypropylene, a polyurethane, a silicone resin, a silicone a natural rubber, a styrene-butadiene; a nitrile rubber, a polysulphide rubber, a vinyl-ethylene, a polyvinyl acetate, a silicate or polysilicate; a hydraulic setting Portland cement, a sodium aluminate or gypsum (Plaster of Paris); a glass composition; a ceramic or refractory composition; or mineral.

16. A coating composition effective in emitting heat without breaking down when connected to a source of electricity, which comprises:

(a) a binder;

(b) a first electrically conductive carbon black particle generated by high temperature pyrolysis of acetylene;

(c) one or more of a second electrically conductive carbon black particle or a graphite particle, which is less conductive than said first carbon black particle (b) and which functions as a resister in said coating composition; and (d) a volatile solvent.

17. The electrically conductive coating composition of claim 16, wherein the weight amount of (b) and (c) together ranges from between about 5 and 75 weight-% based on the non-volatile solids content of the coating composition.

18. The electrically conductive coating composition of claim 17, wherein said binder is one or more of an acrylic, an alkyd, a cellulosic, an epoxy, a fluoro-plastic, an ionomer, a natural rubber, a nylon, a phenolic, a polyamide, a polybutadiene, a polyester, a polyimide, a polypropylene, a polyurethane, a silicone resin, a silicone a natural rubber, a styredne-butadiene; a nitrile rubber, a polysulphide rubber, a vinyl-ethylene, a polyvinyl acetate, asilicate or polysilicate; a hydraulic setting Portland cement, a sodium aluminate or gypsum (Plaster of Paris); a glass composition; a ceramic or refractory composition; or mineral.

19. The electrically conductive coating composition of claim 17, wherein the weight amount of (b) and (c) together ranges from between about 10 and 20 weight-% based on the non-volatile solids content of the coating composition.

20. The electrically conductive coating composition of claim 16 wherein each of said carbon (b) and said second particle (c) is present in an amount of at least about 1 wt-%.

* * * * *